US008397524B2

(12) United States Patent
Lee

(10) Patent No.: US 8,397,524 B2
(45) Date of Patent: Mar. 19, 2013

(54) REFRIGERATOR AND SERVICE SYSTEM OF PARTS FOR THE SAME

(75) Inventor: Ik-Kyu Lee, Changwon (KR)

(73) Assignee: LG Electronics Inc., Seoul (KR)

( * ) Notice: Subject to any disclaimer, the term of this patent is extended or adjusted under 35 U.S.C. 154(b) by 448 days.

(21) Appl. No.: 12/674,607

(22) PCT Filed: Aug. 20, 2008

(86) PCT No.: PCT/KR2008/004848

§ 371 (c)(1),
(2), (4) Date: Feb. 22, 2010

(87) PCT Pub. No.: WO2009/025497

PCT Pub. Date: Feb. 26, 2009

(65) Prior Publication Data

US 2011/0132009 A1 Jun. 9, 2011

(30) Foreign Application Priority Data

Aug. 23, 2007 (KR) ..... 10-2007-0084724

(51) Int. Cl.
*F25B 49/00* (2006.01)

(52) U.S. Cl. ..... 62/127; 62/389

(58) Field of Classification Search ..... 62/129, 62/389, 441, 127; 713/300, 340; 340/310.06, 340/310.01
See application file for complete search history.

(56) References Cited

U.S. PATENT DOCUMENTS

| | | | | |
|---|---|---|---|---|
| 5,478,990 | A * | 12/1995 | Montanari et al. | 235/375 |
| 6,453,687 | B2 * | 9/2002 | Sharood et al. | 62/127 |
| 6,826,267 | B2 * | 11/2004 | Daum et al. | 379/102.03 |
| 6,877,297 | B2 * | 4/2005 | Armington et al. | 53/502 |
| 6,989,751 | B2 * | 1/2006 | Richards | 340/572.4 |
| 7,096,221 | B2 * | 8/2006 | Nakano | 340/6.1 |
| 7,178,349 | B2 * | 2/2007 | Roh et al. | 62/125 |
| 2001/0052896 | A1 | 12/2001 | Yun | |
| 2002/0029575 | A1 * | 3/2002 | Okamoto | 62/125 |
| 2003/0065560 | A1 * | 4/2003 | Brown et al. | 705/14 |
| 2004/0050079 | A1 * | 3/2004 | Holmes et al. | 62/187 |
| 2005/0127177 | A1 * | 6/2005 | Dearing et al. | 235/385 |
| 2005/0137943 | A1 * | 6/2005 | Holzman | 705/28 |
| 2005/0194437 | A1 * | 9/2005 | Dearing et al. | 235/382 |
| 2005/0258961 | A1 * | 11/2005 | Kimball et al. | 340/572.1 |
| 2006/0143520 | A1 * | 6/2006 | Matsushima et al. | 714/25 |
| 2006/0148063 | A1 * | 7/2006 | Fauzzi et al. | 435/286.4 |
| 2007/0069018 | A1 * | 3/2007 | Dearing et al. | 235/385 |
| 2007/0199108 | A1 * | 8/2007 | Angle et al. | 901/17 |

FOREIGN PATENT DOCUMENTS

| | | | |
|---|---|---|---|
| JP | 2005-077022 | A | 3/2005 |
| JP | 2007-114999 | A | 5/2007 |
| KR | 10-2001-0113397 | A | 12/2001 |
| KR | 10-2006-0103014 | A | 9/2006 |

* cited by examiner

*Primary Examiner* — Mohammad Ali
(74) *Attorney, Agent, or Firm* — Birch, Stewart, Kolasch & Birch, LLP

(57) ABSTRACT

Provided is a refrigerator. A refrigerator according to an embodiment includes a main body configured with a plurality of parts, a door coupled to the main body, an RF reader provided in the main body to read out information recorded in each RF tag attached to the parts, a display part provided on the door to display replacement information or abnormal states of the parts, and a controller for controlling the operation of the display part.

4 Claims, 2 Drawing Sheets

REFRIGERATOR AND SERVICE SYSTEM OF PARTS FOR THE SAME

TECHNICAL FIELD

The present disclosure relates to a refrigerator and a service system of parts for the same.

BACKGROUND ART

Generally, a refrigerator is an appliance which stores food at low temperatures. Such a refrigerator includes a main body in which a storeroom is provided, and a door for selectively opening or closing the storeroom. The storeroom may be partitioned into a freezer compartment and a refrigeration compartment, each of which may selectively be opened or closed by the door.

When failure occurs in the parts of the refrigerator, a user cannot accurately know which part failure actually occurs in. Accordingly, there is an inconvenience in that the user has to contact a service technician for the repair of the refrigerator.

Even if the service technician is contacted from the user, since the service technician must personally check for accurately determining failed part, much time is spent in the determination and there is an inconvenience caused by the check.

Moreover, the user does not accurately know a replacement time of the parts that should periodically be replaced, for example, a filter. Accordingly, there is an inconvenience in that the user must directly contact the service technician for the replacement of the parts.

DISCLOSURE OF INVENTION

Technical Problem

Embodiments provide a refrigerator which displays the replacement information and abnormal state for parts, thereby enabling users to easily check the replacement information and abnormal state for the parts.

Embodiments also provide a refrigerator and a service system of parts for the same, which send information for parts to a service center when the replacement or repair of the parts is required, thereby allowing users to accurately receive a service for the parts.

Technical Solution

In one embodiment, a refrigerator includes: a main body configured with a plurality of parts; a door coupled to the main body; an RF reader provided in the main body to read out information recorded in each RF tag attached to the parts; a display part provided on the door to display replacement information or abnormal states of the parts; and a controller for controlling the operation of the display part.

In another embodiment, a service system of parts for a refrigerator includes: an RF tag attached to the each part; a refrigerator in which the parts are mounted; a display part provided on the refrigerator to display the unique information and state information of the each part; and a service center server for receiving the unique information and state information of the each part over a network, wherein the refrigerator includes: an RF reader for reading out unique information of the each part recorded in the RF tag; a memory for storing the read information; and a controller for controlling the display part and determining an abnormal state of the each part.

In another embodiment, a service system of parts for a refrigerator includes: an RF tag attached to the each part; a refrigerator in which the parts are decouplably mounted; a display part provided on the refrigerator to display information of the each part; and a service center server for receiving the unique information and replacement information of the each part over a network, wherein the refrigerator comprises: an RF reader for reading out unique information of the each part recorded in the RF tag; a memory for storing the read information; and a controller for determining an replacement time of the each part, wherein the replacement time of the each part is reckoned from after the RF reader receives the RF tag.

The details of one or more embodiments are set forth in the accompanying drawings and the description below. Other features will be apparent from the description and drawings, and from the claims.

Advantageous Effects

Embodiments accurately determine information for parts which require replacement or repair to display the determined information, and thus a user can easily determine which part should be replaced or repaired.

Embodiments can remove inconvenience to a service technician having to personally check parts necessary for replacement or repair by sending information for parts requiring replacement or repair to a service center, and thus corresponding parts can be replaced or repaired quickly and accurately.

BEST MODE FOR CARRYING OUT THE INVENTION

Reference will now be made in detail to the embodiments of the present disclosure, examples of which are illustrated in the accompanying drawings.

Figure 1:
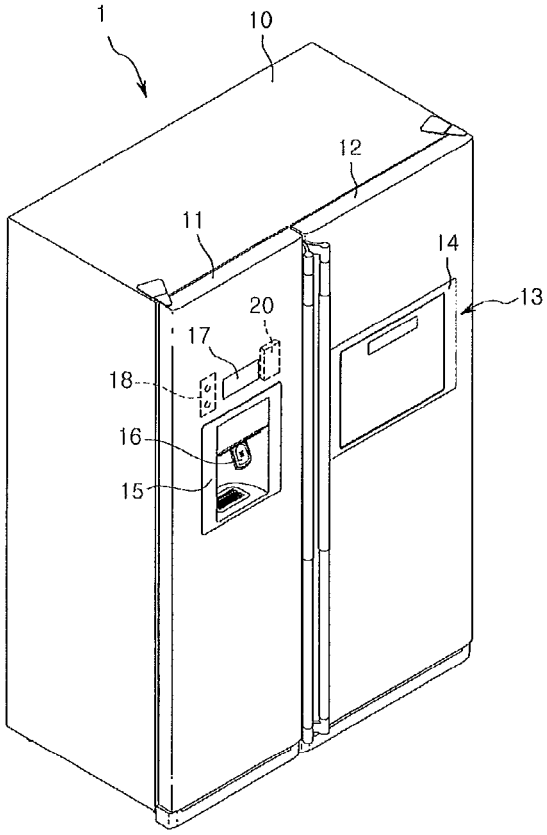
FIG. 1 is a perspective view of a refrigerator according to an embodiment.

FIG. 1 is a perspective view of a refrigerator according to an embodiment.

Referring to FIG. 1, a refrigerator 1 according to an embodiment includes a main body 10 in which a storeroom is provided, and a refrigerator door for opening or closing the storeroom.

As an example, the storeroom includes a freezer compartment and a refrigeration compartment. Therefore, the refrigerator door includes a freezer compartment door 11 and a refrigeration compartment door 12 for opening or closing the freezer compartment and the refrigeration compartment respectively.

In an embodiment, the freezer compartment and the refrigeration compartment are partitioned to the left and right. However, in terms of the spirit and scope of an embodiment, the position of the freezer compartment and the refrigeration compartment is not limited to this embodiment.

The refrigeration compartment door 12 includes a home bar 13 which can allow a user to take out the food from the refrigeration compartment in the outside of the refrigerator 1 without opening the refrigeration compartment door 12, wherein the home bar 13 includes a home bar door 14.

A dispenser 15 allowing a user to dispense the ice or water from the refrigerator 1 in the outside of the refrigerator 1 is provided in the freezer compartment door 11, wherein the dispenser 15 includes a dispensing lever 16. Although not shown, an ice maker making ice and a cask storing water may be provided in the freezer compartment door 11.

A display part 17 displaying the operation state of the refrigerator 1 is provided above the dispenser 15, and a manipulator for inputting the operation conditions of the refrigerator 1 is disposed in the one side of the display part 17.

Furthermore, the freezer compartment door 11 includes a radio frequency (RF) reader 20 recognizing RF tags which are attached to each part used in the refrigerator 1. When the RF reader 20 recognizes the RF tag, the unique information of a corresponding part recognized by the RF reader 20 is stored in the refrigerator 1.

As an example, the RF reader 20 may be disposed in the freezer compartment 11, but an embodiment is not limited to this. As another example, the RF reader 20 may be disposed in the refrigeration compartment door 12 or the main body 10.

The operation of the refrigerator 1 will simply be described below.

In the manufacture of the refrigerator 1 or the replacement of a part, unique information recorded in the RF tag attached to the part is read out by the RF reader 20, and the read unique information is stored in the refrigerator 1.

When the part operates in an abnormal state or the replacement of the part is required, the display part 17 displays the unique information of the part and whether the refrigerator 1 is in the abnormal state or the replacement of the part is required.

Figure 2:
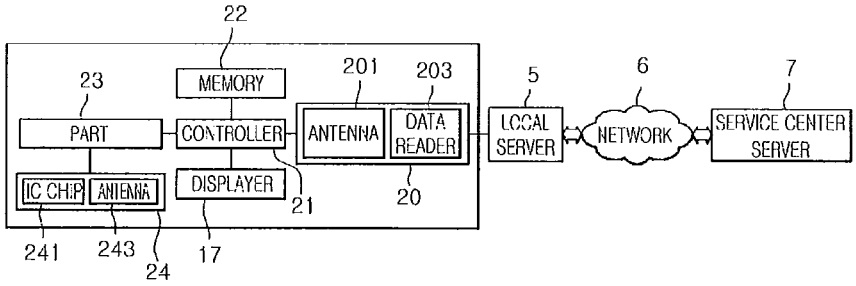
FIG. 2 is a block diagram of a service system of parts for a refrigerator according to an embodiment.

FIG. 2 is a block diagram of a service system of parts for a refrigerator according to an embodiment.

Referring to FIG. 2, a service system of parts for a refrigerator according to an embodiment includes the refrigerator 1, a local server 5 for sending the state information and unique information of a part 23 constituting the refrigerator 1, a service center server 7 for receiving the state information and unique information of the part 23 from the local server 5, and a network 6 for connecting the local server 5 with the service center server 7.

In detail, the refrigerator 1 includes the RF reader 20 for recognizing the RF tag 24 attached to the part 23 constituting the refrigerator 1, a memory 22 for storing the unique information of the part 23 read out from the RF reader 20, a controller 21 for controlling the operation of the part 23 and determining the abnormal state of the part 23, and the display part 17 for displaying the abnormal state and unique information of the part 23.

More specifically, the part 23 denotes an electronic part which is controlled by the controller 21. Examples of the electronic part may include a fan motor for driving a fan, a temperature sensor for sensing the temperature of a storeroom, a valve for opening or closing an oil path, an ice maker for making ice, and a compressor for compressing refrigerant.

The part 23 is driven by a control signal transmitted from the controller 21. When failure or malfunction occurs in the part 23, the controller 21 recognizes the abnormal state of the part 23.

The RF tag 24 is attached to the part 23. The RF tag 24 includes an integrated circuit (IC) chip 241 for recording the unique information of the part 23, and an antenna 243 for radiating information recorded in the IC chip 241 via a radio frequency signal. The manufacture date, part number, etc of the part 23 are recorded in the IC chip 241.

The RF reader 20 includes an antenna 201 for exchanging a radio frequency signal with the RF tag 24, and a data reader 203 for processing information received by the antenna 201.

When the RF reader 20 requests tag data to the RF tag 24, the RF tag 24 transmits the tag data to the RF reader 20 via a radio frequency signal.

When the part 23 to which the RF tag 24 is attached is mounted in the refrigerator 1, the RF reader 20 reads out information recorded in the RF tag 24 and transmits the read information to the controller 21, wherein the transmitted information is stored in the memory 22.

When malfunction or failure occurs in the part 23, the controller 21 allows the display part 17 to display the abnormal state of the part 23. At this point, information displayed on the display part 17 includes the unique information of the part 23 as well as the abnormal state of the part 23. In this way, as the abnormal state of the part 23 is displayed to the outside, a user can accurately determine parts of an abnormal state.

The local server 5 is disposed in a place where the refrigerator 1 is disposed, and may be connected to the refrigerator 1 via wire communication or wireless communication. The local sever 5 transmits the state information and unique information of the part 23 received by the controller 21 to the service center server 7.

Hereinafter, a service method of parts of a refrigerator according to an embodiment will be described.

Figure 3:
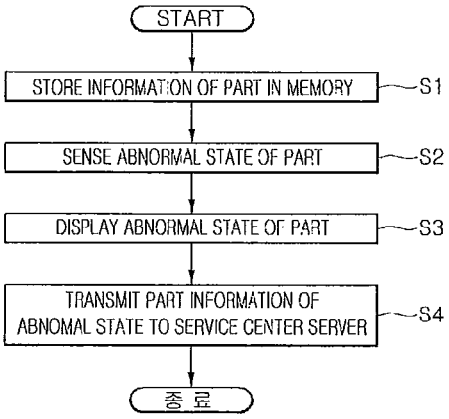
FIG. 3 is a flowchart illustrating a service method of parts for a refrigerator according to an embodiment.

Referring to FIG. 3, in the manufacture of the refrigerator 1 or in the course of the replacement of the part 23, the RF reader 20 reads out information recorded in the RF tag 24 attached to the part 23. At this point, the read information is stored in the memory 22 in operation S1.

When malfunction or failure occurs in the part 23, the controller 21 senses the abnormal state of the part 23 in operation S2. Then, the unique information of the abnormal part 23 is loaded in the memory 22, and the display part 17 displays the abnormal state and unique information of the part 23 to the outside in operation S3.

Furthermore, the state information and unique information of the part 23 are transmitted to the service center server 7 over the local server 5 and the network 6 in operation S4.

In this way, when the state information and unique information of the part 23 are transmitted to the service center server 7, a technician of a service center checks the transmitted information, and thus the technician can replace or repair the part 23 quickly and accurately.

Moreover, since a service technician need not personally check which part is in an abnormal state, inconvenience to the service technician can be removed.

Figure 4:
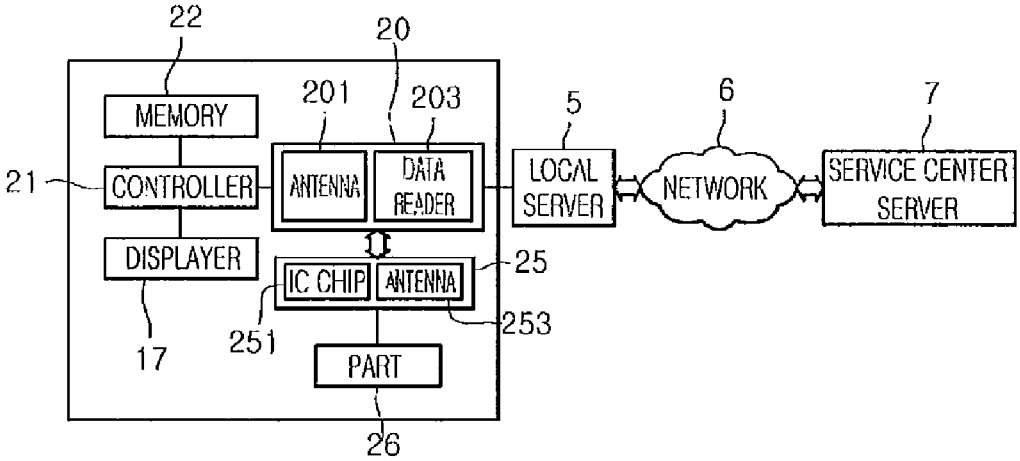
FIG. 4 is a block diagram of a service system of parts for a refrigerator according to another embodiment.
Figure 5:
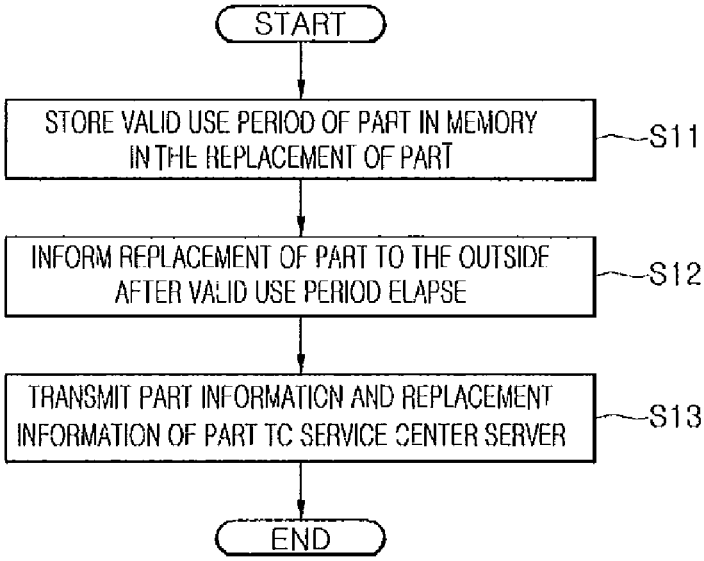
FIG. 5 is a flowchart illustrating a service method of parts for a refrigerator according to another embodiment.

FIG. 4 is a block diagram of a service system of parts for a refrigerator according to another embodiment. FIG. 5 is a flowchart illustrating a service method of parts for a refrigerator according to another embodiment.

The spirit and scope of an embodiment are the same as those of another embodiment, but an embodiment and another embodiment have difference in kinds of parts. Hereinafter, the characteristic portions of another embodiment will only be described below, and the same portions as an embodiment will be quoted from the description of an embodiment.

Referring to FIGS. 4 and 5, a part 26 according to another embodiment is a part which is not controlled by the controller 21 and should be replaced periodically. For example, the part 26 may include a filter purifying water dispensed by the dispenser 15. The part 26 to which an RF tag 25 is attached is mounted in the refrigerator 1.

When the part 26 is attached to the refrigerator 1, information recorded in the RF tag 25 attached to the part 26 is read out, and the read information is stored in the memory 22. In detail, a valid use period from the replacement date of the part 26 to the next replacement date of the part 26 and the unique information of the part 26 are stored in the memory 22 in operation S11.

The controller 21 determines whether the valid use period of the part 26 elapses. When the valid use period elapses as a result of the determination, the controller 21 allows the display part 17 to display the replacement information of the part 26 in operation S12. That is, the memory 22 stores the next replacement date of the part 26, and the controller 21 determines whether the replacement date of the part 26 elapses.

Furthermore, the replacement information and unique information of the part 26 are transmitted to the service center server 7 over the local server 5 and the network 6 in operation S13.

In this way, when the replacement information and unique information of the part 26 are transmitted to the service center server 7, a technician of a service center checks the transmitted information, and thus the technician can replace the part 26 quickly and accurately.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

INDUSTRIAL APPLICABILITY

Embodiments provide a refrigerator and a service system of parts for the same, which send information for parts to a service center when the replacement or repair of the parts is required, thereby allowing users to accurately receive a service for the parts.

The invention claimed is:

1. A refrigerator, comprising:
a main body configured with at least one part;
a door coupled to the main body;
an RF reader provided in the main body to read out information recorded in an RF tag attached to the at least one part;
a display part provided on the door to display replacement information or abnormal state information of the at least one part; and
a controller for controlling the operation of the display part, the controller configured to:
determine a replacement time of the at least one part or an abnormal state of the at least one part;
send the information of the at least one part received from the RF reader and replacement information or abnormal state information of the at least one part to a service center server when the abnormal state or replacement time of the at least one part is determined by the controller; and
control the display part to display the replacement information or abnormal state information of the at least one part.

2. The refrigerator according to claim 1, wherein the door comprises:
a dispenser for dispensing water of the refrigerator in the outside; and
a filter for filtering water dispensed through the dispenser, wherein the filter is the at least one part.

3. The refrigerator according to claim 1, wherein the controller controls the at least one part.

4. The refrigerator according to claim 1, wherein the replacement time of the at least one part is determined from after the RF tag is recognized by the RF reader.

* * * * *